US005988616A

United States Patent [19]

Fuller et al.

[11] Patent Number: 5,988,616

[45] Date of Patent: Nov. 23, 1999

[54] FULL FACE PAD

[75] Inventors: Anthony B. Fuller, De Witt; Steven E. Zlomke, Beatrice, both of Nebr.

[73] Assignee: American Tool Companies, Inc., Hoffman Estates, Ill.

[21] Appl. No.: 08/883,397

[22] Filed: Jun. 26, 1997

[51] Int. Cl.[6] ..... B25B 1/00

[52] U.S. Cl. ..... 269/6; 269/147; 269/148; 269/149; 269/283; 269/284

[58] Field of Search ..... 269/6, 147, 148, 269/149, 150, 166, 283, 284; 81/487

[56] References Cited

U.S. PATENT DOCUMENTS

| | | |
|---|---|---|
| D. 274,034 | 5/1984 | Lacina . |
| D. 331,180 | 11/1992 | Sorensen . |
| D. 340,851 | 11/1993 | Sorensen . |
| D. 341,069 | 11/1993 | Sorensen . |
| D. 366,819 | 2/1996 | Wooster, Jr. et al. . |
| D. 366,820 | 2/1996 | Wooster, Jr. et al. . |
| 2,258,686 | 10/1941 | Olney . |
| 2,340,316 | 2/1944 | Fest . |
| 2,519,107 | 8/1950 | Brown . |
| 2,766,649 | 10/1956 | Labry, Jr. . |
| 2,778,257 | 1/1957 | Linskey et al. . |
| 2,796,787 | 6/1957 | Aske . |
| 4,252,305 | 2/1981 | Pasch . |
| 4,905,550 | 3/1990 | Albrecht . |
| 5,143,359 | 9/1992 | Bush . |
| 5,243,883 | 9/1993 | Savage . |

OTHER PUBLICATIONS

American Tool Catalog, published by American Tool Companies, Inc., pp. 10–11 and 13. It is believed that the catalog was published before Jun. 26, 1997.

Seven photographs of a clamping pad with a side opening and a ridge near the opening. The pad shown in the photographs is belived to have been first available to the public in 1991.

*Primary Examiner*—Timothy V. Eley
*Assistant Examiner*—Benjamin M. Halpern
*Attorney, Agent, or Firm*—Brinks Hofer Gilson & Lione

[57] ABSTRACT

A full face clamp pad having an engagement surface and a receiving element attached to the engagement surface, wherein the receiving element defines a closed opening that faces the engagement surface. The engagement surface and the receiving element define a second opening that faces in a direction substantially parallel to the engagement surface.

68 Claims, 5 Drawing Sheets

FULL FACE PAD

BACKGROUND OF THE INVENTION

1. Field of the Invention

This invention relates to a full face pad for attachment to a clamping jaw.

2. Discussion of Related Art

Bar clamps and C-clamps typically employ a fixed jaw and a movable jaw that is movable towards the fixed jaw. When an object is placed between the fixed and movable jaw, the movable jaw is moved towards the fixed jaw until both jaw contact the object. There is often a concern that the pressing of the jaws against the object will damage the object. In order to alleviate this concern, plastic pads have been placed on the jaws. Examples of such plastic pads are the full face pads manufactured by American Tool Companies, Inc. which are used with the bar clamps manufactured by Petersen Manufacturing Co., Inc. made under the QUICK-GRIP® trademark. Another design for full face pads is disclosed in U.S. Pat. No. Design D 341,069.

SUMMARY OF THE INVENTION

One aspect of the present invention regards a full face clamp pad having an engagement surface, a first wall attached to and extending away from the engagement surface and a second wall attached to and extending away from the engagement surface, wherein the first wall is separated from and faces the second wall. The full face pad also includes a bar extending from the first wall to the second wall and spaced from the engagement surface so that the bar, first wall, second wall and engagement surface define an opening.

Another aspect of the present invention regards a full face clamp pad having an engagement surface and a receiving element attached to the engagement surface, wherein the receiving element defines a closed opening that faces the engagement surface. The engagement surface and the receiving element define a second opening that faces in a direction substantially parallel to the engagement surface.

A third aspect of the present invention regards a full face clamp pad that includes an engagement surface and first and second walls attached to and extending away from the engagement surface, wherein the first wall is separated from and faces the second wall. The full face clamp pad further includes a first ledge portion attached to the first wall, spaced from the engagement surface and extending toward the second wall and a second ledge portion attached to the second wall, spaced from the engagement surface and extending toward the first wall.

All three aspects of the above-mentioned invention present the advantage of improved securement of a full face clamp pad to a clamping jaw.

DESCRIPTION OF THE PREFERRED EMBODIMENT

Figure 2:
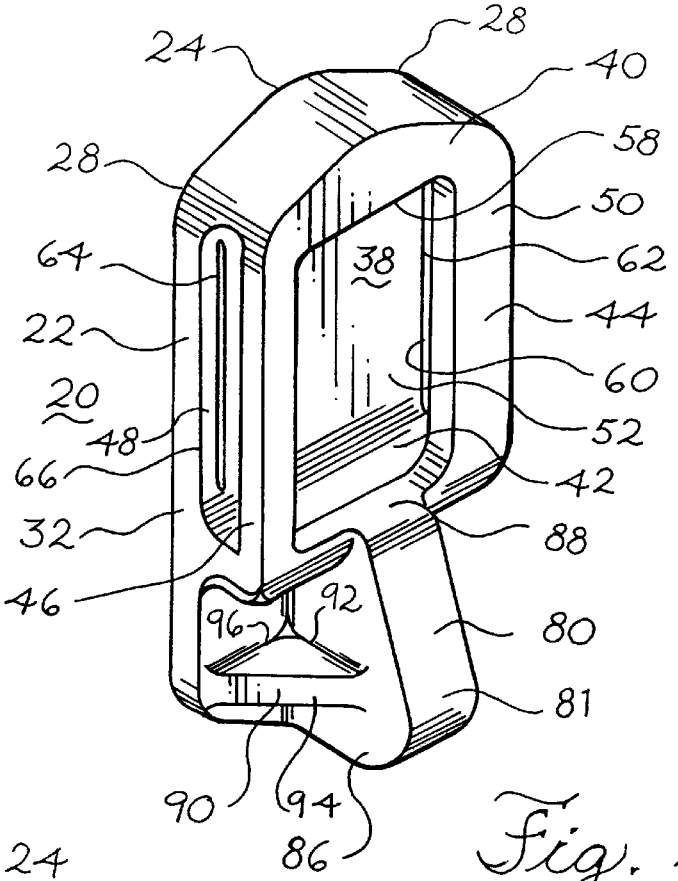
FIG. 2 is a perspective view of a full face pad used with the bar clamp of FIG. 1.
Figure 3:
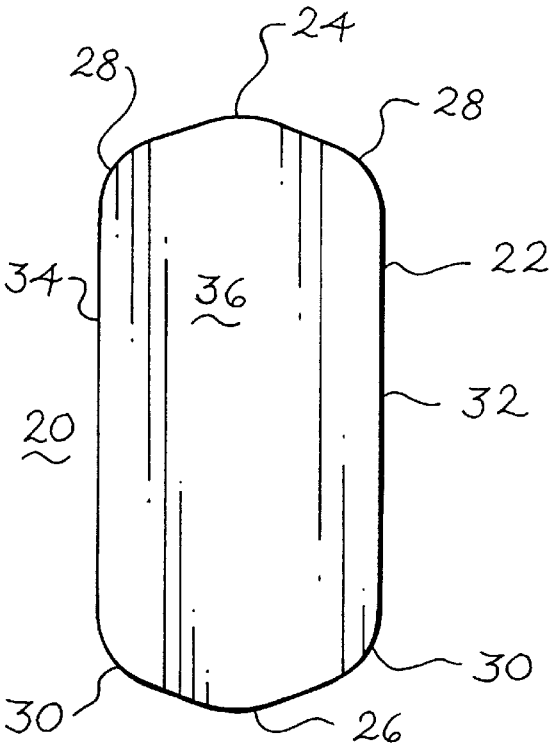
FIG. 3 is a front view of the full face pad of FIG. 2.
Figure 4:
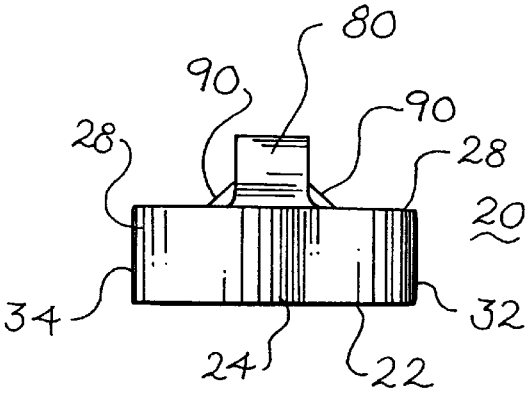
FIG. 4 is a top view of the full face pad of FIG. 2.

A full face clamp pad 20 according to the present invention is shown in FIGS. 1–8. As shown in FIGS. 3–7, the full face clamp pad 20 has a six sided engagement surface 22 that has a maximum length of approximately 3¼" as measured from corners 24 and 26 and a minimum length of approximately 2¾" as measured from corners 28 and 30. Front side edges 32 and 34 each have a length of approximately 2¼" and are parallel to and separated from one another by approximately 1½". Top corner 24 and bottom corner 26 are aligned with each other along a line parallel to the side edges 32 and 34. Furthermore, top corner 24 rises above corners 28 by an amount that is equal to the amount that bottom comer is below corners 30 which is approximately ¼". The front side 36 of the engagement surface 22 is shown in FIG. 3 and is designed to firmly clamp a workpiece.

Figure 1:
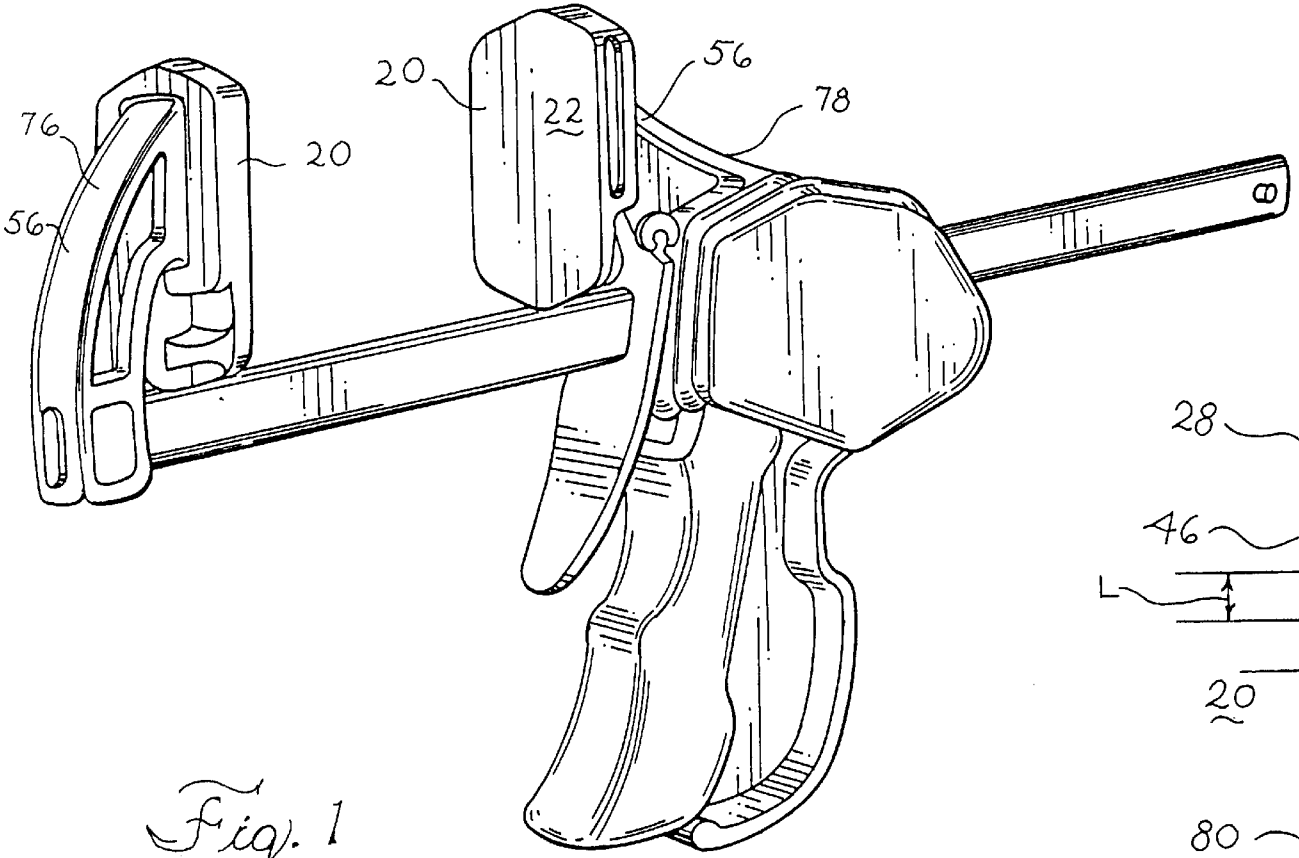
FIG. 1 is a perspective view of a bar clamp that employs a pair of full face pads according to the present invention.
Figure 8B:
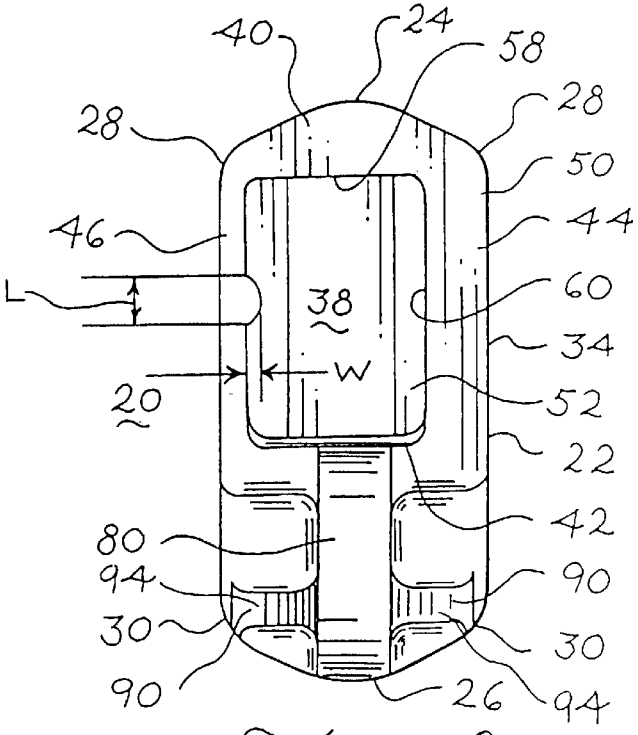
FIG. 8B is a rear view of a second embodiment of a full face pad to be used with the bar clamp of FIG. 1.
Figure 8A:
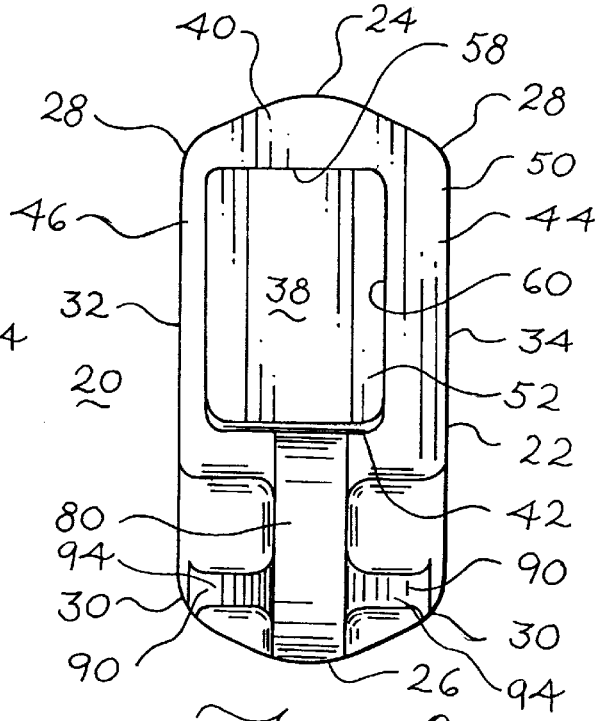
FIG. 8A is a rear view of the full face pad of FIG. 2.
Figure 10:
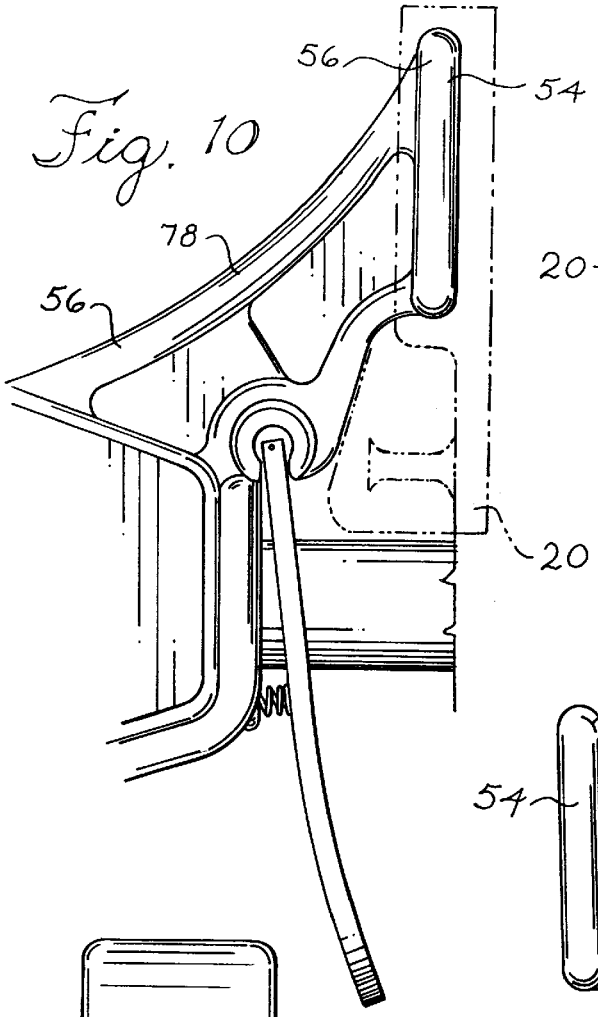
FIG. 10 shows a left side view of the clamping jaw of FIG. 9.

As shown in FIGS. 2 and 8A, the rear side 38 of the engagement surface 22 is attached to a top wall 40 and a bottom wall 42 that both extend away from the rear side 38. The top wall and bottom wall each have a length of approximately 1" as measured from inside edge to inside edge and rise above the rear side 38 by approximately ⅜". The top wall 40 is parallel to and separated from the bottom wall 42 by approximately 1⅝" so that the top wall 40 faces the bottom wall 42. A side wall 44 having a length of approximately 1⅝" and a height above the rear side 38 of approximately ⅜" is attached perpendicular to both the top wall 40 and the bottom wall 42.

Figure 5:
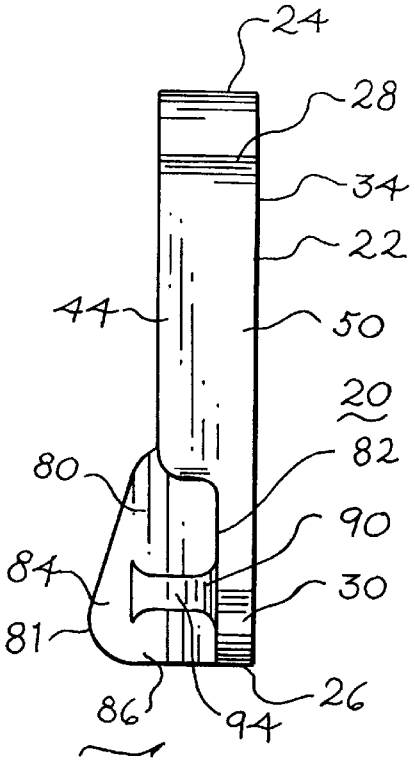
FIG. 5 a right side view of the full face pad of FIG. 2.
Figure 6:
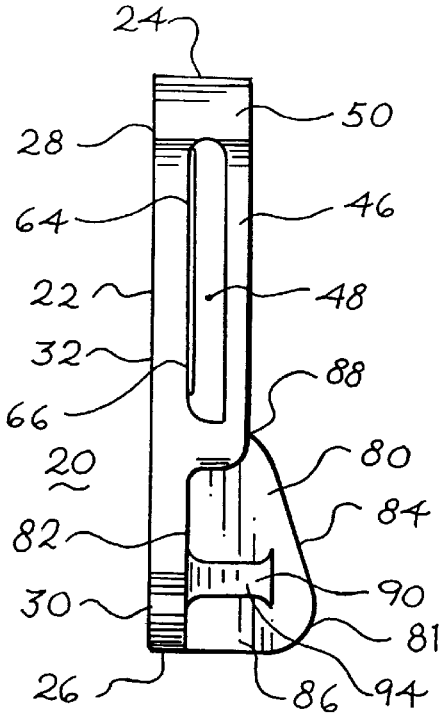
FIG. 6 is a left side view of the full face pad of FIG. 2.
Figure 7:
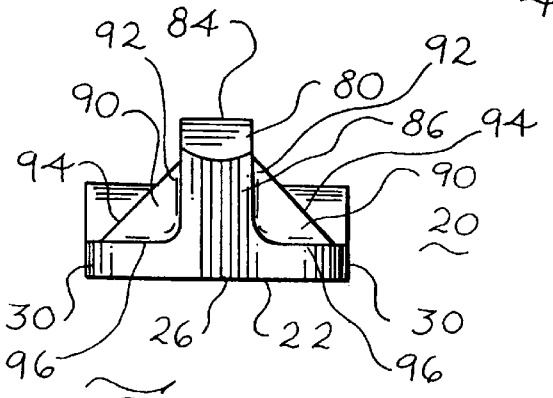
FIG. 7 is a bottom view of the full face pad of FIG. 2.

A rectangular bar 46 is attached to the top wall 40 and the bottom wall 42 by having a top ledge portion 43 that is attached to the top wall 40 and a bottom ledge portion 45 that is attached to the bottom wall 42. The top and bottom ledge portions 43 and 45 are aligned with each other and extend toward the bottom wall 42 and the top wall 40, respectively, so that they meet and are integrally attached to one another midway between the top and bottom walls. The rectangular bar 46 and the top and bottom ledge portions 43 and 45 each have a width of approximately 3/16" and a height of approximately ⅛" so as to form a rectangular cross-section as viewed along the length of the bar 46. The bar 46 has a length of approximately 1⅝". The bar 46 and the top and bottom ledge portions 43 and 45 are spaced above the rear side 38 of the engagement surface 22 such that the bar 46, the top and bottom walls 40 and 42 and the engagement surface 22 define at least a portion of a perimeter or closed path that defines a rectangular opening 48 contained in a plane as shown in FIGS. 2, 5 and 6. As shown in FIGS. 2, 5 and 6, the opening 48 has a first side that faces an interior volume of space defined by the top and bottom walls 40 and 42 and the engagement surface 22. The opening 48 has a second side opposite the first side and fails to face any portion of the pad 20. The opening 48 is positioned such that the side wall 44 faces the opening 48. It is understood that the bar 46 may have other shapes 48 without departing from the spirit of the invention. For example, the bar 46 may be shaped to form non-rectangular openings. Furthermore, as shown in FIG. 8B, the full face pad 20 may have the same structure as described with respect to FIGS. 1–8A except that a rounded protuberance 49 is formed centrally along the length of the bar 46. The protuberance 49 has a length L of approximately 5/16", a width W of approximately 1/16" and a height of approximately 1/8". When the clamping face 54 is inserted into the opening 52, the protuberance 49 engages a portion of the rear edge 77 of the clamping face 54 so as to provide additional structure for preventing the clamping face 56 from being removed from the opening 52. Note that the rectangular bar 46 may be replaced by having the top and bottom ledge portions 43 and 45 being spaced apart from each other by a gap or space (not shown) that is located approximately midway between the top and bottom walls.

As shown in FIGS. 2 and 8A, the bar 46 and the three walls 40, 42 and 44 define a receiving element 50 that is attached to the engagement surface 22, wherein the receiving element 50 defines a closed rectangular opening 52 that faces the rear side 38 of the engagement surface 22. Opening 52 has a length of approximately 1 5/8" and a width of approximately 1". The rear side 38 and the receiving element 50 also define the rectangular opening 48 which faces in a direction substantially parallel to the rear side 38 of the engagement surface 22.

The opening 52 is designed to have a rectangular clamping face 54 of a clamping jaw 56 inserted therethrough so that the clamping face 54 abuts the rear side 38 of the engagement surface 22. To improve the attachment of the full face pad 20 to the clamping face 54, rectangular-like grooves 58 and 60 are formed in the top wall 40 and side wall 44, respectively. Groove 58 faces the bottom wall 42 and groove 60 faces the opening 48. The grooves 58 and 60 intersect one another so as to form an L-shaped groove 62. Note that the opening 48 is provides an advantage over replacing the bar 46 with a wall that extends to the rear side 38 of the engagement surface 22, in that the opening 48 aids the formation of the grooves 58 and 60 during the molding process.

Further attachment of the full face clamp pad 20 to the clamping face 54 is provided by a ridge 64 that is integrally formed from and extends outward from the rear side 38 of the engagement surface 22 toward the bar 46 and the top and bottom ledge portions 43 and 45 by approximately 1/32" as shown in FIGS. 2 and 6. The ridge 64 is rectangular in shape having a length of approximately 1 3/8", a height of approximately 1/32" and a width of approximately 1/32". The ridge 64 runs parallel to the edge 66 of the rear side 38 and is offset from the edge 66 by approximately 1/8" so that the ridge extends along the engagement surface 22 and is adjacent to the opening 48.

As described previously, the full face clamp pad 20 is attached to the clamping face 54 by inserting the clamping face 54 through the opening 52 so that the edges 68, 70, 72 and 74 of the clamping face 54 are contained between and make contact with the grooves 58, 60, the bottom wall 42 and the ridge 64, respectively. Thus, the full face pad 20 is prevented from slipping off of the clamping face 54. Edge 74 also contacts the rectangular bar 46 which provides further resistance to having the full face clamp pad 20 from being removed from the clamping face 54. Note that the bar 46 provides an advantage over a wall that replaces the bar and extends to the rear side 38 of the engagement surface 22, in that the bar 46 would be more flexible than such a wall and, thus, would be easier to deform so as to allow the clamping face 54 to enter the opening 52.

Figure 9:
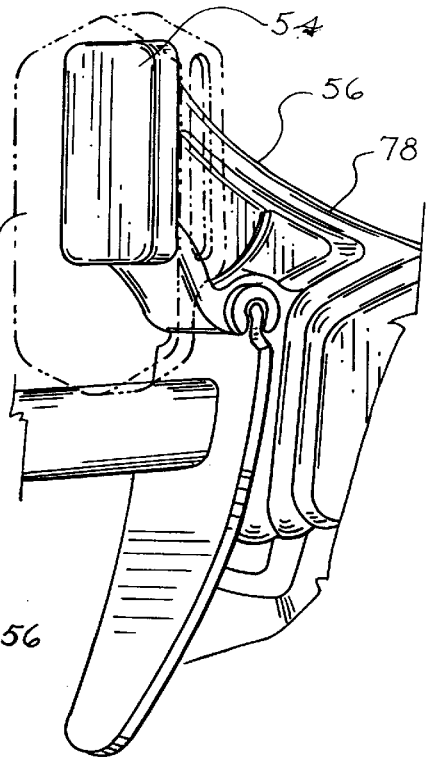
FIG. 9 shows a perspective view of the movable clamping jaw of FIG. 1 with the full face pad of FIGS. 1–8 in phantom.
Figure 12:
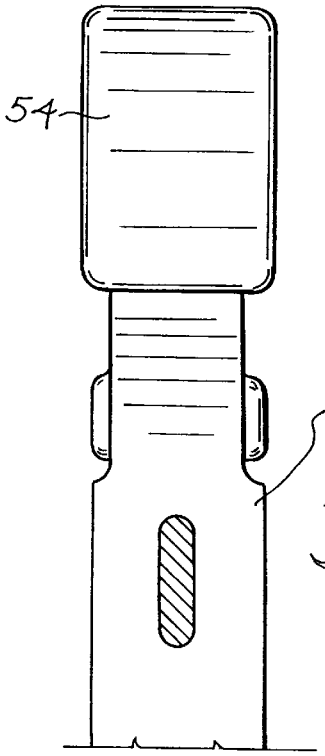
FIG. 12 shows a front view of the clamping jaw of FIG. 9.
Figure 11:
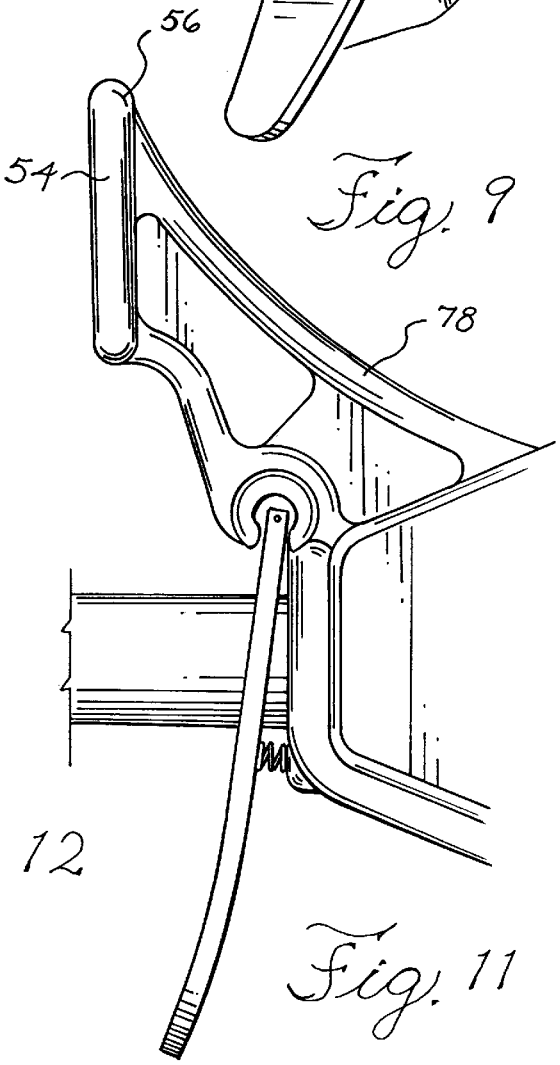
FIG. 11 shows a right side view of the clamping jaw of FIG. 9.
Figure 14:
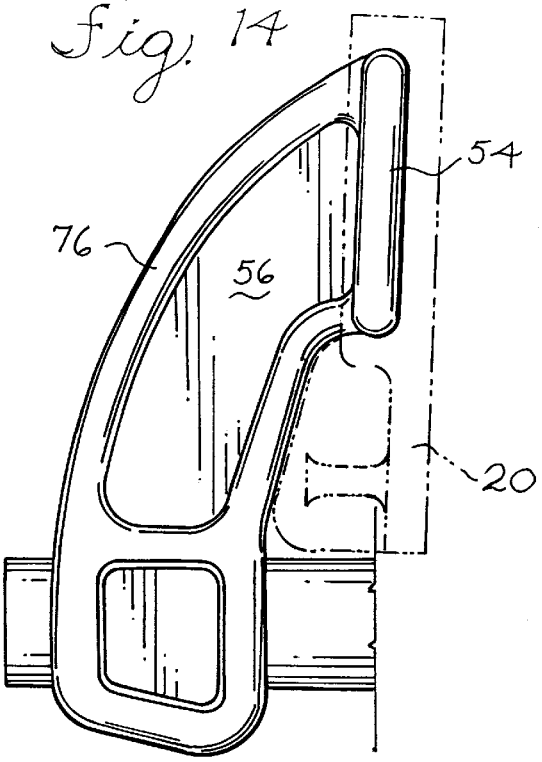
FIG. 14 shows a left side view of the clamping jaw of FIG. 13.
Figure 13:
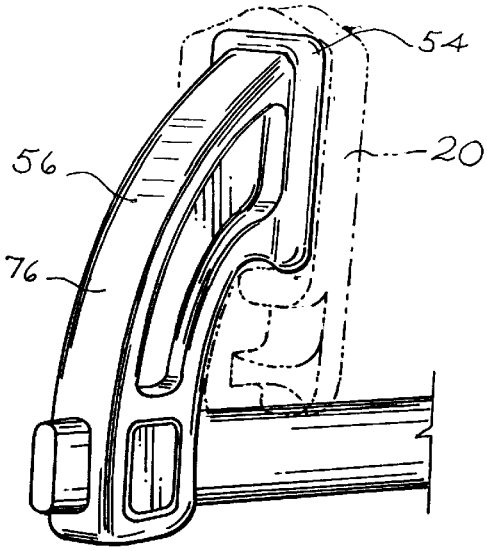
FIG. 13 shows a perspective view of the fixed clamping jaw of FIG. 1 with the full face pad of FIGS. 1–8 in phantom.
Figure 15:
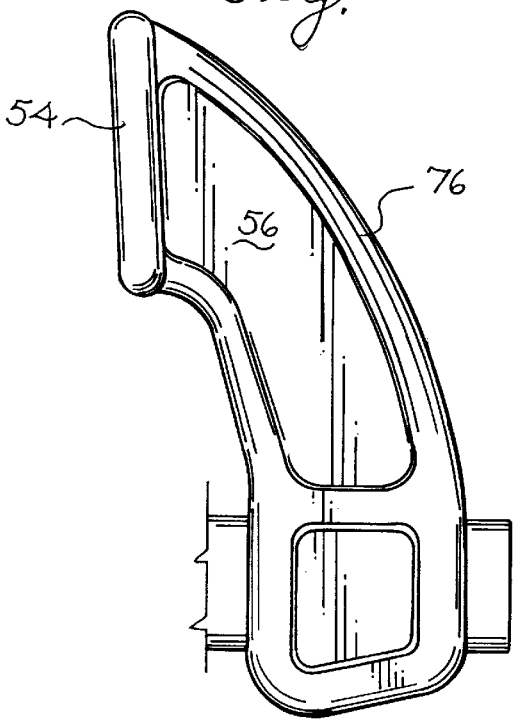
FIG. 15 shows a right side view of the clamping jaw of FIG. 13.
Figure 16:
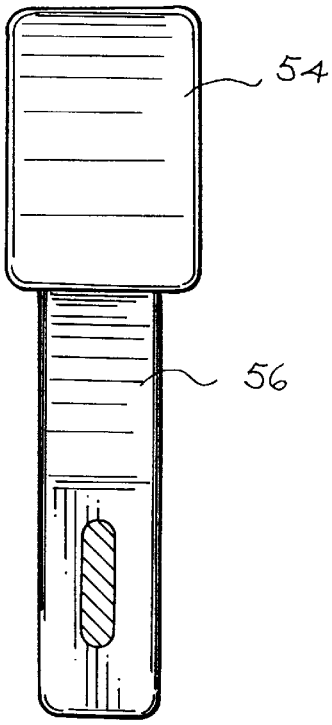
FIG. 16 shows a front view of the clamping jaw of FIG. 13.

As shown in FIGS. 9–6, the clamping face 54 to which the full face pad 20 is attached is integrally formed with a jaw 56 that is attached to one end of a curved clamp body 76, 78 that is either movable (FIGS. 9–12) or fixed (FIGS. 13–16). In the case of both clamp bodies 76, 78, the full face pad 20 has a support 80 integrally attached thereto which extends below the clamping face 54. Preferably only a portion 81 of the support 80 engages a portion 83 of the clamp body 76, 78. In another embodiment not shown, almost the entire top portion 84 of the support 80 can be shaped so as to snugly fit against the side of the clamp body 76, 78. The support 80 gives added support to the lower portion of the full face pad 20 when it is clamping an object. As shown in FIGS. 2 and 4–8, the support 80 is integrally formed with a central portion of the bottom wall 42 and has a trapezoidal shape with a base 82 having a length of approximately 1 1/16", a top portion 84 having a length of approximately 1 1/4" and legs 86 and 88 having lengths of approximately 7/8" and 1/2", respectively. The support 80 has a thickness of approximately 3/8". Two triangular buttresses 90 are integrally attached perpendicular to the support 80 at about 5/8" from the side of the bottom wall 42 facing the buttresses 90. Each buttress 90 has a thickness of approximately 3/16", and sides 92, 94 and 96 having lengths of approximately 1/2", 11/16", and 1/2", respectively.

The above described full face pad of FIGS. 1–16 preferably is made of a resilient material, such as a thermal plastic elastomer, and is manufactured by a well known injection molding process. Examples of suitable thermal plastic elastomers are those sold by Monsanto under the trade name Santoprene and those sold by Advance Elastomer under the trade name Vyram.

The foregoing description is provided to illustrate the invention, and is not to be construed as a limitation. Numerous additions, substitutions and other changes can be made to the invention without departing from its scope as set forth in the appended claims. For example, the side wall 44 and the bar 46 can be reversed so that the opening 48 is formed on the side opposite to that shown in FIG. 2.

We claim:

1. A full face clamp pad comprising:

an engagement surface;

a first wall attached to and extending away from said engagement surface;

a second wall attached to and extending away from said engagement surface, wherein said first wall is separated from and faces said second wall and wherein said first wall, said second wall and said engagement surface define an interior volume of space; and a bar extending from said first wall to said second wall and spaced from said engagement surface so that said bar, first wall, second wall and engagement surface define at least a portion of a perimeter of an opening contained in a plane, wherein said opening has a first side that faces said interior volume of space and a second side opposite said first side that fails to face any portion of the clamp pad.

2. The full face clamp pad of claim 1, wherein said opening is rectangular in shape.

3. The full face clamp pad of claim 1, wherein said first wall comprises a groove formed therefrom and facing said second wall.

4. The full face clamp pad of claim 1, comprising a third wall attached to said first wall and said second wall.

5. The full face clamp pad of claim 4, wherein said third wall faces said opening.

6. The full face clamp pad of claim 4, wherein said first side wall comprises a first groove formed therefrom and facing said second wall; and said third wall comprises a second groove formed therefrom and facing said opening.

7. The full face clamp pad of claim 6, wherein said first groove intersects said second groove.

8. The full face clamp pad of claim 7, wherein said first and second grooves form an L-shaped groove.

9. The full face clamp pad of claim 1, wherein said first wall is parallel to said second wall.

10. The full face clamp pad of claim 4, wherein said first wall is parallel to said second wall; and wherein said third wall is perpendicular to said first wall.

11. A full face clamp pad comprising:

an engagement surface;

a first wall attached to and extending away from said engagement surface;

a second wall attached to and extending away from said engagement surface, wherein said first wall is separated from and faces said second wall;

a bar extending from said first wall to said second wall and spaced from said engagement surface so that said bar, first wall, second wall and engagement surface define an opening; and a ridge extending from said engagement surface and adjacent to said opening.

12. The full face clamp pad of claim 11, comprising a third wall attached to said first wall and said second wall.

13. The full face clamp pad of claim 12, wherein said third wall faces said opening.

14. The full face clamp pad of claim 12, wherein said first side wall comprises a first groove formed therefrom and facing said second wall; and said third wall comprises a second groove formed therefrom and facing said opening.

15. The full face clamp pad of claim 14, wherein said first groove intersects said second groove.

16. The full face clamp pad of claim 15, wherein said first and second grooves form an L-shaped groove.

17. The full face clamp pad of claim 11, wherein said first wall is parallel to said second wall.

18. The full face clamp pad of claim 12, wherein said first wall is parallel to said second wall; and wherein said third wall is perpendicular to said first wall.

19. The full face clamp pad of claim 1, wherein said bar comprises a rectangular cross-section.

20. The full face clamp pad of claim 1, wherein said bar comprises a protuberance.

21. The full face clamp pad of claim 19, wherein said bar comprises a protuberance.

22. A clamping jaw comprising:

a clamp body;

a clamping face attached to one end of said clamp body; and a full face pad attached to said clamping face, wherein said full face pad comprises:

an engagement surface;

a first wall attached to and extending away from said engagement surface;

a second wall attached to and extending away from said engagement surface, wherein said first wall is separated from and faces said second wall and wherein said first wall, said second wall and said engagement surface define an interior volume of space; and a bar extending from said first wall to said second wall and spaced from said engagement surface so that said bar, first wall, second wall and engagement surface define at least a portion of a perimeter of an opening contained in a plane, wherein said opening has a first side that faces said interior volume of space and a second side opposite said first side that fails to face any portion of the clamp pad.

23. The clamping jaw of claim 22, wherein said opening is rectangular in shape.

24. The clamping jaw of claim 22, wherein said first wall comprises a groove formed therefrom and facing said second wall.

25. The clamping jaw of claim 22, comprising a third wall attached to said first wall and said second wall.

26. The clamping jaw of claim 25, wherein said third wall faces said opening.

27. The clamping jaw of claim 25, wherein said first side wall comprises a first groove formed therefrom and facing said second wall; and said third wall comprises a second groove formed therefrom and facing said opening.

28. The clamping jaw of claim 27, wherein said first groove intersects said second groove.

29. The clamping jaw of claim 28, wherein said first and second grooves form an L-shaped groove.

30. The clamping jaw of claim 22, wherein said first wall is parallel to said second wall.

31. The clamping jaw of claim 25, wherein said first wall is parallel to said second wall; and wherein said third wall is perpendicular to said first wall.

32. A clamping jaw comprising:

a clamp body;

a clamping face attached to one end of said clamp body; and a full face pad attached to said clamping face, wherein said full face pad comprises:

an engagement surface;

a first wall attached to and extending away from said engagement surface;

a second wall attached to and extending away from said engagement surface, wherein said first wall is separated from and faces said second wall;

a bar extending from said first wall to said second wall and spaced from said engagement surface so that said bar, first wall, second wall and engagement surface define an opening; and a ridge extending from said engagement surface and adjacent to said opening.

33. A clamping jaw comprising:

a clamp body;

a clamping face attached to one end of said clamp body; and a full face pad attached to said clamping face, wherein said full face pad comprises:

an engagement surface;

a first wall attached to and extending away from said engagement surface;

a second wall attached to and extending away from said engagement surface, wherein said first wall is separated from and faces said second wall;

a third wall attached to said first wall and said second wall;

a bar extending from said first wall to said second wall and spaced from said engagement surface so that said bar, first wall, second wall and engagement surface define an opening; and a ridge extending from said engagement surface and adjacent to said opening.

34. The clamping jaw of claim 22, comprising a support attached to said full face pad and extending below said clamping face and engaging a portion of said clamp body.

35. The clamping jaw of claim 32, wherein said clamping face is contained between and contacts said first wall, said second wall and said ridge.

36. The clamping jaw of claim 33, wherein said clamping face is contained between and contacts said first wall, said second wall, said third wall and said ridge.

37. The clamping jaw of claim 22, wherein said bar comprises a rectangular cross-section.

38. The clamping jaw of claim 22, wherein said bar comprises a protuberance.

39. The clamping jaw of claim 37, wherein said bar comprises a protuberance.

40. A full face clamp pad comprising:

an engagement surface;

a receiving element attached to said engagement surface, wherein said receiving element defines an opening that faces said engagement surface, wherein said opening is defined by a closed path; and wherein said engagement surface and said receiving element define a second opening that face in a direction substantially parallel to said engagement surface.

41. The full face clamp pad of claim 40, wherein said first opening is rectangular in shape.

42. The full face clamp pad of claim 40, wherein said second opening is rectangular in shape.

43. The full face clamp pad of claim 41, wherein said second opening is rectangular in shape.

44. A full face clamp pad comprising:

an engagement surface;

a receiving element attached to said engagement surface, wherein said receiving element defines a closed opening that faces said engagement surface;

wherein said engagement surface and said receiving element define a second opening that faces in a direction substantially parallel to said engagement surface; and a ridge extending from said engagement surface and adjacent to said second opening.

45. A full face clamp pad comprising:

an engagement surface;

a receiving element attached to said engagement surface, wherein said receiving element defines a closed opening that is rectangular in shape and faces said engagement surface;

wherein said engagement surface and said receiving element define a second opening that is rectangular in shape and faces in a direction substantially parallel to said engagement surface; and a ridge extending from said engagement surface and adjacent to said second opening.

46. A clamping jaw comprising:

a clamp body;

a clamping face attached to one end of said clamp body; and a full face pad attached to said clamping face, wherein said full face pad comprises:

an engagement surface;

a receiving element attached to said engagement surface, wherein said receiving element defines an opening that faces said engagement surface and in which said clamping face is inserted, wherein said opening is defined by a closed path; and wherein said engagement surface and said receiving element define a second opening that face in a direction substantially parallel to said engagement surface.

47. The clamping jaw of claim 46, wherein said first opening is rectangular in shape.

48. The clamping jaw of claim 46, wherein said second opening is rectangular in shape.

49. The clamping jaw of claim 47, wherein said second opening is rectangular in shape.

50. A clamping jaw comprising:

a clamp body;

a clamping face attached to one end of said clamp body; and a full face pad attached to said clamping face, wherein said full face pad comprises:

an engagement surface;

a receiving element attached to said engagement surface, wherein said receiving element defines a closed opening that faces said engagement surface and in which said clamping face is inserted;

wherein said engagement surface and said receiving element define a second opening that face in a direction substantially parallel to said engagement surface; and a ridge extending from said engagement surface and adjacent to said second opening.

51. A clamping jaw comprising:

a clamp body;

a clamping face attached to one end of said clamp body; and a full face pad attached to said clamping face, wherein said full face pad comprises:

an engagement surface;

a receiving element attached to said engagement surface, wherein said receiving element defines a closed opening that is rectangular in shape and faces said engagement surface and in which said clamping face is inserted;

wherein said engagement surface and said receiving element define a second opening that is rectangular in shape and faces in a direction substantially parallel to said engagement surface; and a ridge extending from said engagement surface and adjacent to said second opening.

52. The clamping jaw of claim 50, wherein said clamping face contacts said ridge.

53. The full face clamp pad of claim 50, wherein said first ledge portion is aligned with said second ledge portion.

54. The full face clamp pad of claim 50, wherein said first wall comprises a groove formed therefrom and facing said second wall.

55. The full face clamp pad of claim 50, comprising a third wall attached to said first wall and said second wall.

56. The full face clamp pad of claim 55, wherein said third wall faces said first and second ledge portions.

57. The full face clamp pad of claim 55, wherein said first side wall comprises a first groove formed therefrom and facing said second wall; and said third wall comprises a second groove formed therefrom and facing said opening.

58. The full face clamp pad of claim 57, wherein said first groove intersects said second groove.

59. A full face clamp pad comprising:

an engagement surface;

a first wall attached to and extending away from said engagement surface;

a second wall attached to and extending away from said engagement surface, wherein said first wall is separated from and faces said second wall;

a first ledge portion attached to said first wall, spaced from said engagement surface and extending toward said second wall;

a second ledge portion attached to said second wall, spaced from said engagement surface and extending toward said first wall; and a ridge extending from said engagement surface toward said first and second ledge portions.

60. A clamping jaw comprising:

a clamp body;

a clamping face attached to one end of said clamp body; and a full face pad attached to said clamping face, wherein said full face pad comprises:

an engagement surface;

a first wall attached to and extending away from said engagement surface;

a second wall attached to and extending away from said engagement surface, wherein said first wall is separated from and faces said second wall;

a first ledge portion attached to said first wall, spaced from said engagement surface and extending toward said second wall;

a second ledge portion attached to said second wall, spaced from said engagement surface and extending toward said first wall; and a ridge extending from said engagement surface toward said first and second ledge portions.

61. The clamping jaw of claim 60, wherein said first ledge portion is aligned with said second ledge portion.

62. The clamping jaw of claim 60, wherein said first wall comprises a groove formed therefrom and facing said second wall.

63. The clamping jaw of claim 60, comprising a third wall attached to said first wall and said second wall.

64. The clamping jaw of claim 63, wherein said third wall faces said first and second ledge portions.

65. The clamping jaw of claim 63, wherein said first side wall comprises a first groove formed therefrom and facing said second wall; and said third wall comprises a second groove formed therefrom and facing said opening.

66. The clamping jaw of claim 65, wherein said first groove intersects said second groove.

67. The full face clamp pad of claim 40, wherein said second opening is contained in a plane, wherein said second opening has a first side that faces an interior volume of space of said clamp pad and a second side opposite said first side that fails to face any portion of the clamp pad.

68. The clamp jaw of claim 46, wherein said second opening is contained in a plane, wherein said second opening has a first side that faces an interior volume of space of said full face pad and a second side opposite said first side that fails to face any portion of the full face pad.

* * * * *

UNITED STATES PATENT AND TRADEMARK OFFICE

CERTIFICATE OF CORRECTION

PATENT NO. : 5,988,616
DATED : November 23, 1999
INVENTOR(S) : Anthony B. Fuller et al.

It is certified that error appears in the above-identified patent and that said Letters Patent is hereby corrected as shown below:

Column 8,
Line 63, claim "53" should be renumbered as -- 55 --
Line 63, delete "claim 50" and substitute -- claim 53 -- in its place --.
Line 65, claim "54" should be renumbered as -- 56 --
Line 65, delete "claim 50" and substitute -- claim 53 -- in its place --.

Column 9,
Line 1, claim "55" should be renumbered as -- 57 --
Line 1, delete "claim 50" and substitute -- claim 53 -- in its place.
Line 3, claim "56" should be renumbered as -- 58 --
Line 3, delete "claim 55" and substitute -- claim 57 -- in its place.
Line 5, claim "57" should be renumbered as -- 59 --
Line 5, delete "claim 55" and substitute -- claim 57 -- in its place.
Line 10, claim "58" should be renumbered as -- 60 --
Line 10, delete "claim 57" and substitute -- claim 59 -- in its place.
Line 12, claim "59" should be renumbered as -- 53 --.
Line 28, claim "60" should be renumbered as -- 54 --.

Column 10,
Line 12, delete "60" and substitute -- 54 -- in its place.
Line 14, delete "60" and substitute -- 54 -- in its place.
Line 17, delete "60" and substitute -- 54 -- in its place.

Signed and Sealed this

Twenty-fifth Day of June, 2002

*Attest:*

*Attesting Officer*

JAMES E. ROGAN
*Director of the United States Patent and Trademark Office*